United States Patent [19]

Iwanami et al.

[11] Patent Number: 4,494,396

[45] Date of Patent: Jan. 22, 1985

[54] MULTISTAGE ROLLING MILL WITH FLATNESS CONTROL FUNCTION

[75] Inventors: Toshio Iwanami, Yokohama; Hajime Watanabe, Yokosuka, both of Japan

[73] Assignee: Ishikawajima-Harima Jukogyo Kabushiki Kaisha, Japan

[21] Appl. No.: 361,970

[22] Filed: Mar. 25, 1982

[30] Foreign Application Priority Data

Apr. 2, 1981 [JP] Japan ..... 56-49960

[51] Int. Cl.[3] ..... B21B 31/16; B21B 31/32

[52] U.S. Cl. ..... 72/243; 72/245

[58] Field of Search ..... 72/241, 242, 243, 245, 72/247, 19, 21, 249

[56] References Cited

U.S. PATENT DOCUMENTS

| | | | |
|---|---|---|---|
| 2,118,284 | 5/1938 | Worthington | 72/241 |
| 3,363,444 | 1/1968 | Caldeback | 72/245 |
| 3,533,263 | 10/1970 | Wochnik et al. | 72/242 |
| 4,132,095 | 1/1979 | Bowman | 72/19 |
| 4,194,382 | 3/1980 | Kajiwara | 72/243 |
| 4,218,905 | 8/1980 | Lehmann et al. | 72/21 |
| 4,365,496 | 12/1982 | Shiozaki et al. | 72/249 |

FOREIGN PATENT DOCUMENTS

| | | | |
|---|---|---|---|
| 126310 | 9/1980 | Japan | 72/243 |

*Primary Examiner*—Lowell A. Larson
*Assistant Examiner*—Jorji M. Griffin

[57] ABSTRACT

The present invention considerably improves the rolling mill in the flatness control function, by arranging either of a pair of upper and lower work rolls as a small-diameter roll, offsetting the small-diameter work roll by a required distance in the rolling direction, providing an intermediate roll between the small-diameter work roll and a backup roll, letting a vertical bending force act on the upper and lower work rolls and the intermediate roll, and letting a horizontal bending force act on the small-diameter work roll.

4 Claims, 17 Drawing Figures

MULTISTAGE ROLLING MILL WITH FLATNESS CONTROL FUNCTION

BACKGROUND OF THE INVENTION

The present invention relates to a multistage rolling mill with a mechanism for controlling the flatness of the rolled product.

In recent years, to control the sectional flatness of the rolled product in the width direction, the work roll bending method by a four high mill has been developed, but the roll bending method adopted is limited in the capability of controlling the flatness of the rolled product.

To obtain a rolled product with a good flatness especially with little variation of thickness in the width direction, it is important to keep the deformation of the work rolls by the rolling load, etc. as small as possible and to enhance the capability of correction by roll bending.

A conventional four high mill has only a roll bending device for vertical bending, and for this reason, it allows only a limited crown correction and can correct only a simple parabolic shape. This allows only the flatness correction of edge waves and center buckles and does not provide sufficient capability in controlling complicated ones such as compound waves, etc. Furthermore, for narrow sheets with a width smaller than ½ of the roll shaft length, unsatisfactory results in flatness correction are obtained.

In this situation, horizontal bending as shown in FIG. 1 was developed.

In the developed rolling mill, work rolls c and d are properly offset in the rolling direction from the vertical line connecting the centers of backup rolls a and b, and support rolls h adapted to move horizontally are arranged through pressure rolls g against the offset work rolls c and d, to allow the flatnesss control of the rolled product horizontally. In this rolling mill, since the flatness control actuator is engaged in horizontal bending only, the control capability is limited, and since the backup rolls are driven, there is possibility of slipping caused at a high draft. In addition, the exchange of the pressure rolls g and the support rolls h takes much time and needs much effort.

The first object of the present invention is to considerably enhance the capability of the rolling mill in controlling the flatness of the rolled product.

The second object of the present invention is not to lower the workability in roll exchange and maintenance in enhancing the capability of controlling the flatness of the rolled product.

The multistage rolling mill with flatness control function according to the present invention is described below in reference to drawings.

DETAILED DESCRIPTION OF THE PREFERRED EMBODIMENTS

At first, the basic principle of the present invention will be described with reference to FIGS. 2 and 3.

Figure 1:
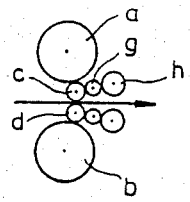
FIG.1 PRIOR ART
FIG. 1 is a schematic view of the above-mentioned prior art rolling mill.
Figure 2:
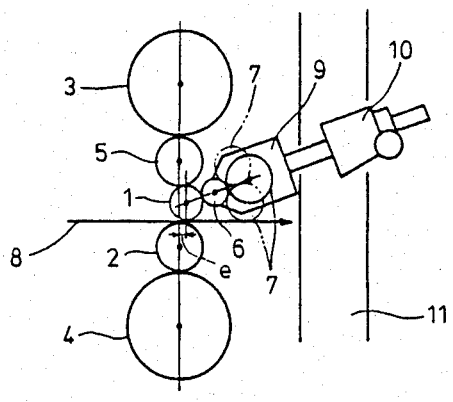
FIG. 2 is an essential view showing the basic structure of the rolling mill according to the present invention.

As shown in FIG. 2, in a rolling mill comprising upper and lower work rolls 1 and 2 and upper and lower backup rolls 3 and 4 supporting said upper and lower work rolls 1 and 2, an intermediate roll 5 almost the same as the lower work roll 2 in diameter is provided between the upper backup roll 3 and the upper work roll 1. The intermediate roll 5 and the lower work roll 2 are positioned on a vertical line, and the upper work roll 1 is formed to be as small in diameter as allowed in view of strength, being positioned properly downstream in the rolling direction (offset e). In this state, if a work 8 is rolled, the upper work roll 1 deflects to get away downstream.

For flatness control by use of this deflection, a pressure roll 6 almost the same as the upper work roll 1 in length is provided on the outer circumference of the upper work roll 1 on the downstream side in the rolling line, to press the upper work roll 1 for adjusting the horizontal deflection of the upper work roll 1. Rolls 7 properly divided in the roll width direction are provided on the pressure roll 6 on the downstream side in the rolling line, to support said pressure roll 6. Each of the divided rolls 7 is supported by a proper support 9 which is arranged to be movable in the direction of the straight line connecting the axes of the upper work roll 1 and the pressure roll 6 by a mover 10 of screw rod type (or cylinder type, etc.) supported by housings 11. As for the divided rolls 7, two sets may be provided in the positions in contact with the straight line connecting the pressure roll 6 and the upper work roll 1 (see the imaginary lines of FIG. 2).

Figure 3:
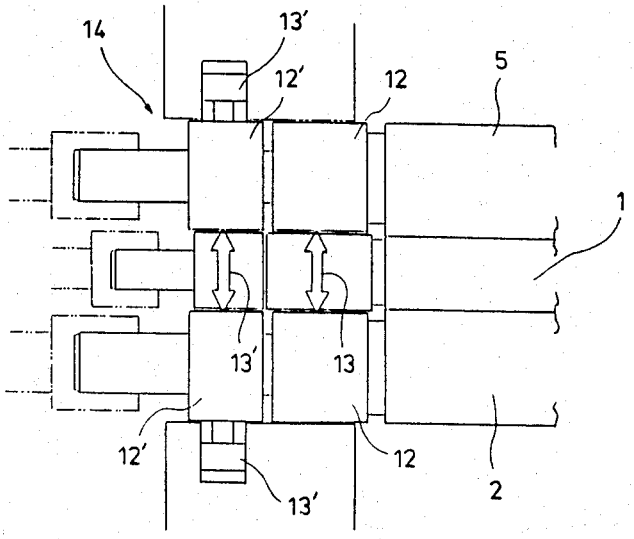
FIG. 3 is a detail view of the roll support in FIG. 2.

Furthermore, as shown in FIG. 3, at the shaft ends of the upper and lower work rolls 1 and 2 and the intermediate roll 5, double chocks 12 and 12' are provided, and cylinders 13 and 13' are provided in association with the respective chocks 12 and 12', as bending devices 14 for vertically bending the upper and lower work rolls 1 and 2 and the intermediate roll 5.

In the multistage rolling mill with the above construction for the flatness control of the work 8, the pressures to the pressure roll 6 are adjusted individually by the action of the movers 10 through the divided rolls 7, to freely adjust the deflection of the upper work roll 1 at the respective portions with the horizontal displacement of the pressure roll 6 due to said pressures as vertical displacement of the work rolls 1 and 2. In this case, when any of the divided rolls 7 is strongly pressed against the pressure roll 6, the clearance between the upper and lower work rolls 1 and 2 at the portion decreases, to decrease the thickness of the work 8 at the portion. On the contrary, when the pressure of the divided roll 7 is weakened, it acts to increase the plate thickness. Furthermore, by the action of the movers 10, the respective divided rolls 7 provided in the width direction can be simultaneously adjusted to be pressed to or moved from the pressure roll 6. Thus, since the deflection of the upper work woll 1 can be freely adjusted at plural portions by adjusting the positions of the divided rolls 7, the flatness of the work 8 can be controlled arbitrarily.

In addition to the above operation, the bending devices 14 provided for the upper and lower work rolls 1 and 2 can be operated, for more accurate flatness control of the work 8.

Furthermore in addition to said operation, the bending device 14 provided for the intermediate roll 5 can be operated, for more accurate and wider-range flatness control of the work 8.

In the above example, any structure allowing the movement in parallel to the upper work roll 1 may be added to the rolls 6 and 7, or any structure allowing the movement of only the pressure roll 6 against the divided rolls 7 or of only the divided rolls 7 against the pressure roll 6 in parallel to the upper work 1 may be added.

Figure 17:
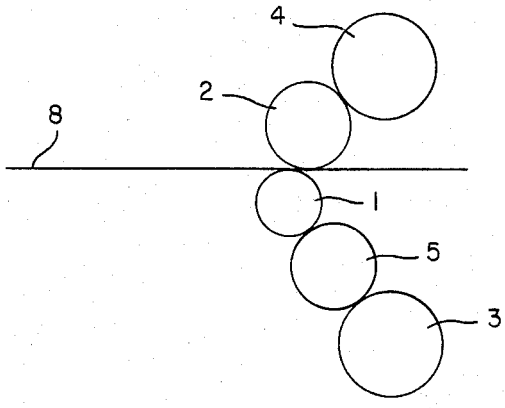
FIG. 17 is a schematic view of a set-up in which horizontal force components are not present in the intermediate and lower work rolls.

If, as shown in FIG. 17, the intermediate roll 5 and the lower work roll 2 are eccentrically arranged on the offset side in the rolling line on the straight line connecting the upper work roll 1 and the upper backup roll 3 and on the straight line connecting the upper work roll 1 and the lower backup roll 4, respectively, the horizontal components of force of the intermediate roll 5 and the lower work roll 2 do not occur.

In FIG. 2, the upper work roll is small in diameter and offset in the rolling direction, but this structure may be applied to the lower work roll. Furthermore, the divided rolls for pressing and supporting the pressure roll may be substituted by divided static pressure pads.

Moreover, the support for the small-diameter work roll may be by means of double chocks and the bending force may be applied to the outer chocks of the latter, thereby applying the horizontal bending from the outer chocks.

The lower work roll 2 is small in diameter, but since the diameter is not too small, it can be driven, to overcome the problems of meandering of the work upon entering, etc.

Thus, according to the present invention;

(I) Since one of the work rolls is made as small as possible in diameter and is offset in the rolling direction, to be controlled horizontally, horizontal bending can be made large, and the arithmetic vertical crown can be made large, to decrease the rolling force and power, and to increase the controllability.

(II) Additional vertical control allows highly accurate control in a very wide range.

(III) A work roll can be driven, and when the work roll is limited in torque, the intermediate roll can be also driven.

(IV) Since the force required, for adjustment is small, edge marks are not made.

(V) Divided pressure devices for supporting the pressure roll can be moved and adjusted individually, to allow complicated flatness control of compound waves, etc.

(VI) If the intermediate roll and the large-diameter work roll are driven, rolling at different speeds can be effected. If the large- and small-diameter work rolls are driven at higher and lower speeds, respectively, rolling at widely different peripheral speeds can be effected.

(VII) If the intermediate roll and the large-diameter work roll are eccentrically arranged between the small-diameter work roll and the respective backup rolls, horizontal components of force can be prevented from occurring in the intermediate roll and the large-diameter roll.

Figure 4:
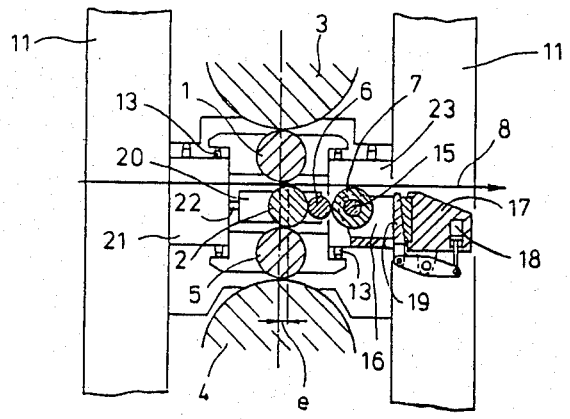
FIG. 4 is a schematic view of the rolling mill showing the first improvement of the present invention.
Figure 5:
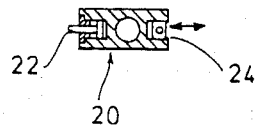
FIG. 5 is a partial illustration of FIG. 4.
Figure 6:
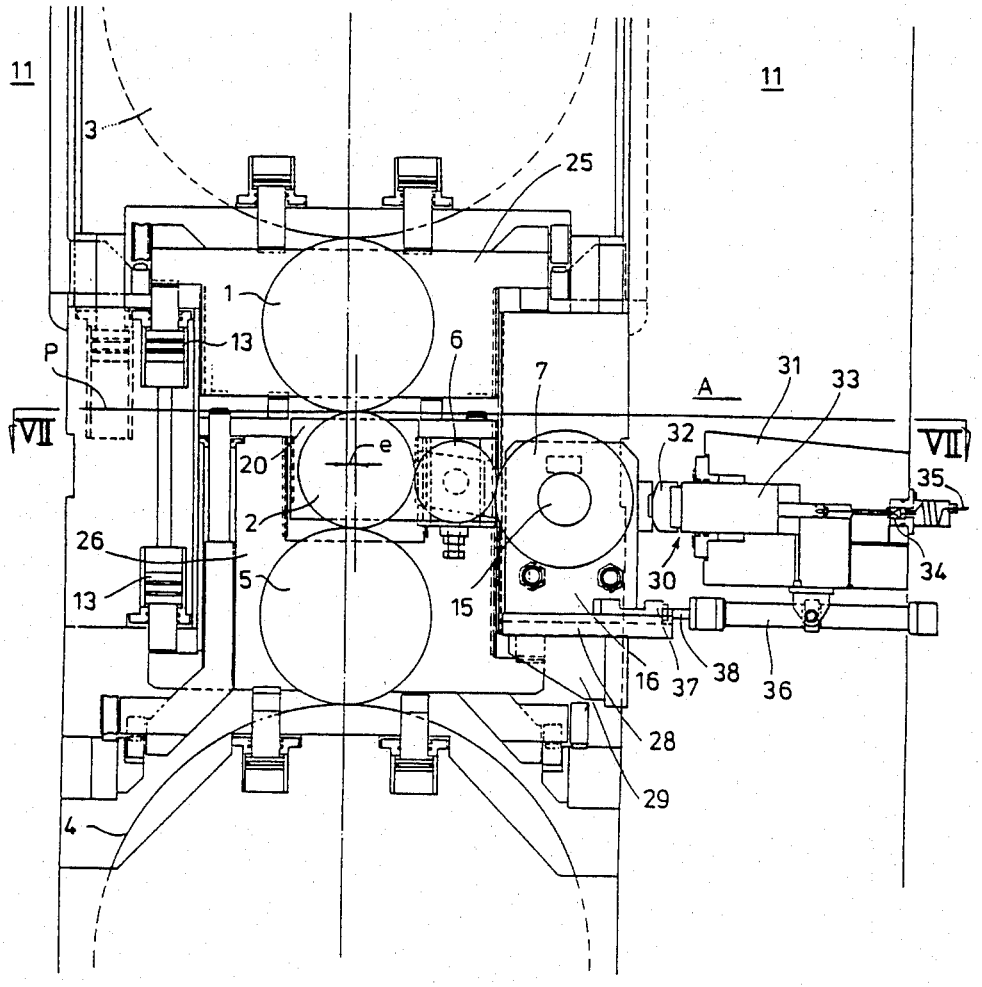
FIG. 6 is a cutaway side view of the rolling mill showing the second improvement of the present invention.
Figure 7:
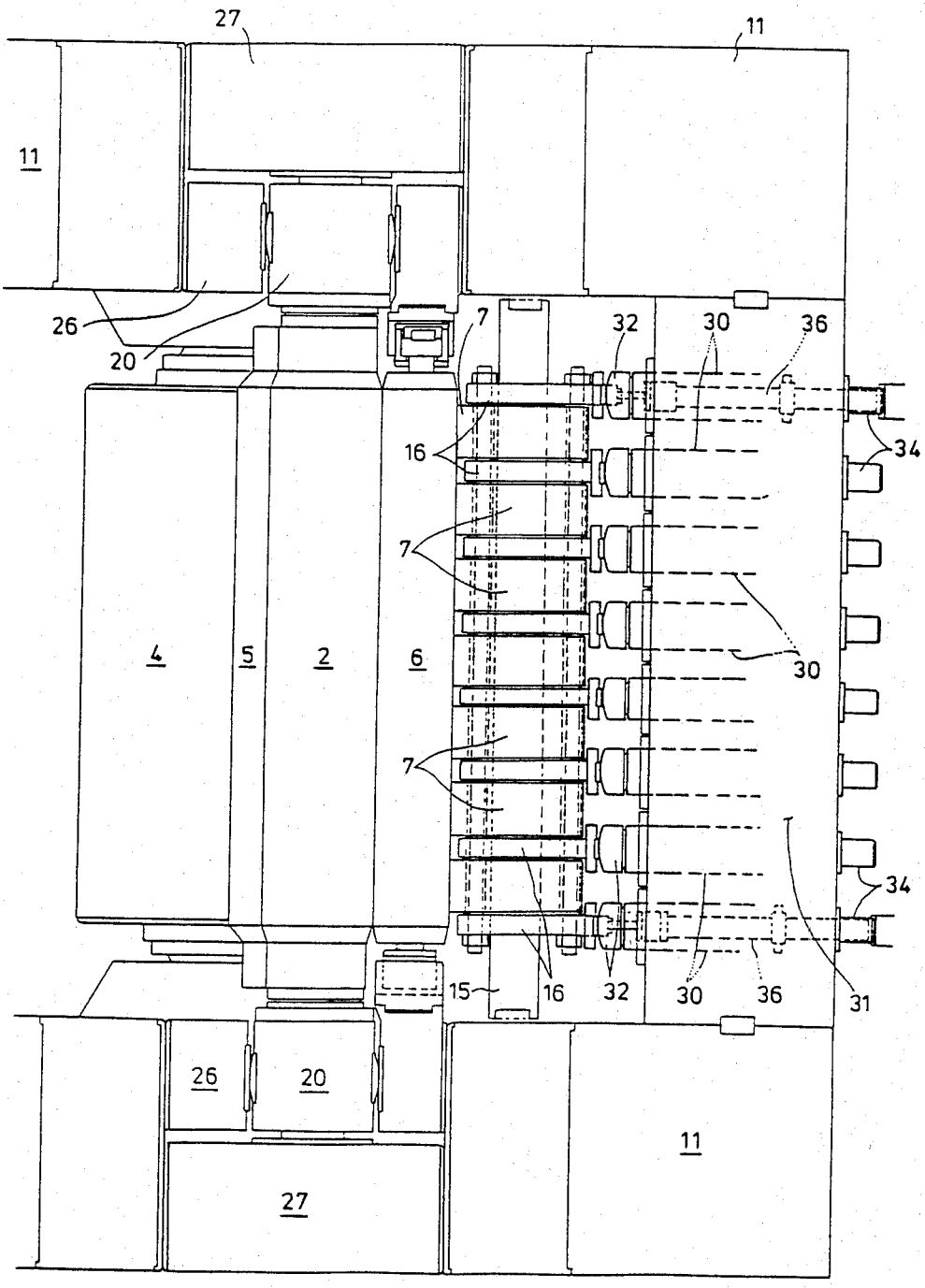
FIG. 7 is a view taken in the direction of the arrow VII—VII of FIG. 6.
Figure 8:
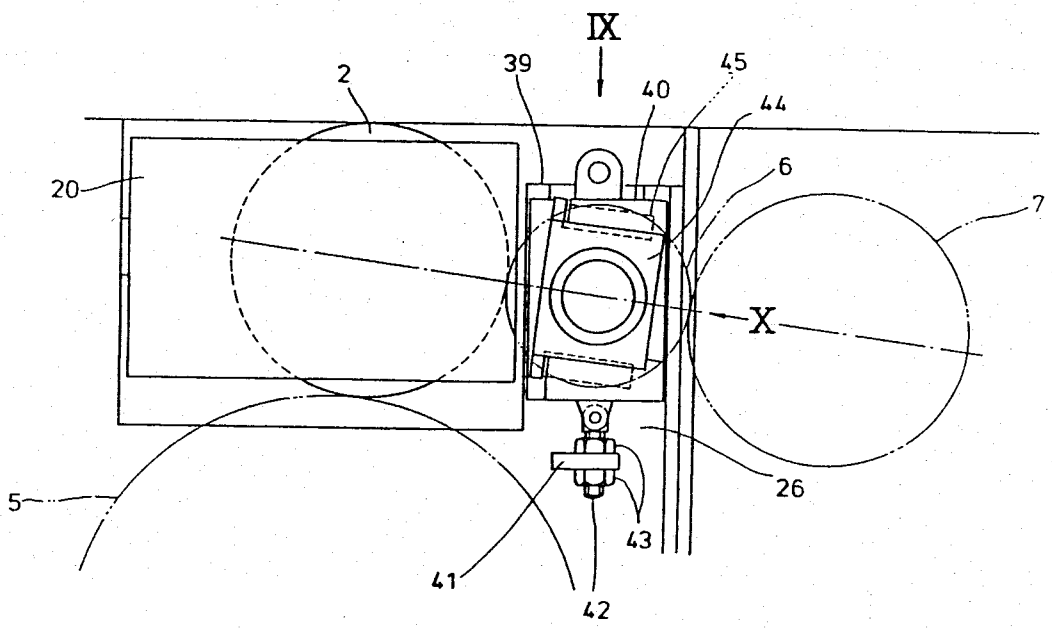
FIG. 8 is a detail view of the pressure roll support mechanism in FIG. 6.
Figure 9:
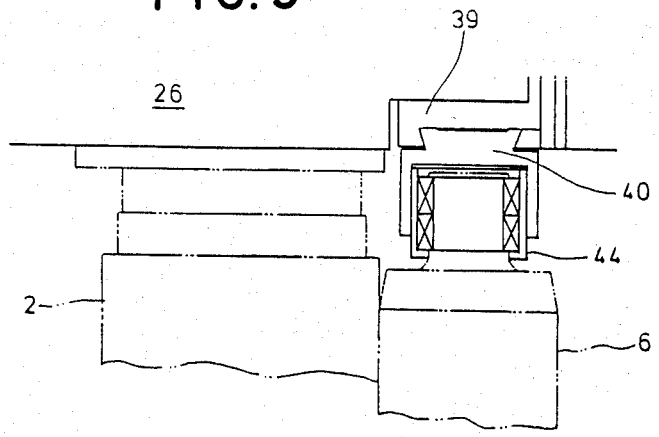
FIG. 9 is a partial view looking in the direction of the arrow IX of FIG. 8.
Figure 10:
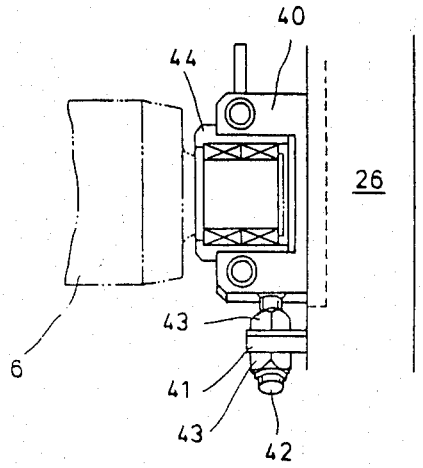
FIG. 10 is a partial view looking in the direction of the arrow X of FIG. 8.

With reference to FIGS. 4 and 5, the first improvement of the present invention will be described.

In FIGS. 4 and 5, the same parts as those shown in FIGS. 2 and 3 are indicated by the same reference numerals.

Said divided rolls 7 are fitted on a shaft 15 at proper intervals, to be in contact with said pressure roll 6, and movable plates 16 are provided between the respective rolls of said shaft 15. Between a fixed member 17 fastened to the housings 11 and each of said movable plates 16, a wedge 19 adapted to be moved by the expansion and contraction of a cylinder 18 is so inserted that by the action of said cylinders 18 the lower work roll 2 may be displaced horizontally through the wedges 19, the movable plates 16, the shaft 15 the divided rolls 7 and the pressure roll 6.

In this rolling mill, bearings 24 of the pressure roll 6 are contained in the journal boxes 20 of the lower work roll 2, to be capable of moving horizontally, as shown in FIG. 5. The lower work roll journal boxes 20 contain, on the upstream side, cylinders 22 adapted to contact upstream-side cylinder blocks 21 on their sides, which adjust and hold the distance against the journal boxes of the upper work roll 1 and the intermediate roll 5. In this structure, the lower work roll 2 can be moved horizontally, and horizontal bending can be applied to the lower work roll 2 from the shaft end portions. The divided rolls 7 are put in a downstream-side cylinder block 23.

In this rolling mill, for the flatness control of the work 8, the cylinders 18 are actuated to move and adjust the wedges 19, the movable plates 16, the shaft 15, and the divided rolls 7 individually, for free adjustment of the deflection of the lower work roll 2 at the respective portions. In this case, if one of the divided rolls 7 is pressed strongly toward the lower work roll 2 through the pressure roll 6, the backlash between the lower work roll 2 and the upper work roll 1 at the portion decreases, to decrease the thickness of the work 8 at the portion, and if the pressure of the divided roll 7 is weakened, the plate thickness at the portion increases. Since the deflection of the lower work roll 2 can be adjusted optionally at a plurality of positions, the flatness of the work 8 can be easily controlled.

Furthermore, if the pressure roll bearings 24 are contained in the lower work roll journal boxes 20, with the divided rolls 7 arranged not to protrude from the downstream-side cylinder block 23, the pressure roll 6 put under the most severe condition can be drawn out of the stand, together with the lower work roll 2, and can be easily fitted in.

As mentioned above, according to the first improvement of the present invention, a first example of the horizontal bending device to obtain a given bending curve in the work roll can be realized, and since the pressure roll and the small-diameter work roll can be handled together, the roll exchange and maintenance are facilitated.

With reference to FIGS. 6 to 10, the second improvement of the present invention will be described.

The parts mentioned before are indicated by the same reference numerals.

The divided rolls 7 are apart from each other as mentioned above and fixed on the shaft 15, and the movable plates 16 are provided between these divided rolls 7 and at both the ends of the shaft 15, to support said shaft 15 rotatably. Regarding the movable plates 16, under those positioned at both the ends of the shaft 15, there are support members 28 with guide surfaces extending in the direction of the rolling line P, and the support members 28 are supported in the housings 11 by brackets 29 fixed to the housings 11. The movable plates 16 ride on the guide surfaces of said support members 28, being able to move in the direction of the rolling line P.

A fluid pressure cylinder 30 for moving each of the movable plates 16 of the divided rolls 7 in parallel to the rolling line P toward the lower work roll 2 is provided for each of the movable plates 16, in a beam 31 connected to both the housings 11. The fluid pressure cylinder 30 has a piston 33 with a spherical pad 32 fitted at the tip, and said piston 33 is forced out by oil pressure, to press the spherical pad 32 against the receiving surface of the movable plate 16. Sensors 34 are provided to detect the positions of the pistons 33 of the respective fluid pressure cylinders 30, for detecting the deflection state of the lower work roll 2. The detected signals are fed through cables 35 to an arithmetic unit, to adjust the oil pressures of the respective fluid pressure cylinders 30, for moving the respective divided rolls 7 individually, thereby controlling the deflection of the lower work roll 2 in the most appropriate condition. Reference numeral 36 indicates fluid pressure cylinders to eliminate the backlash between the spherical pads 32 and the receiving surfaces of the movable plates 16 as well as to serve the exchange of the divided rolls 7, and each of the fluid pressure cylinders 36 is equipped with a piston rod 38 having a hook member 37 provided at its tip. The hook member 37 is engaged with each of the movable plates 16 of the divided rolls 7 provided at both ends.

The support mechanism of the pressure roll 6 will be described below.

A guide 39 is fastened to each of the inner journal boxes 26 of the intermediate roll 5, and said guide 39 and a slider 40 are mutually fitted through a dovetail groove, to be able to slide vertically. The guide 39 and the journal box 26 are mutually fixed by a bracket 41 protruded from the journal box 26 and by a nut 43 through a bolt 42 pivotally fitted to the guide 39. A T-shaped bearing unit 44 for supporting each shaft end of the pressure roll 6 is fitted to the slider 40, to be movable almost in the rolling direction, and a compression spring 45 is between the bearing unit 44 and the slider 40.

For rolling, at first, the nuts 43 are adjusted, to align the centers of the lower work roll 2, the pressure roll 6 and the divided rolls 7 on one straight line.

For the flatness control of the work in the rolling mill composed as mentioned above, the pressures of the divided rolls 7 to the pressure roll 6 are individually adjusted by the action of the respective fluid pressure cylinders 30, to freely adjust the deflection of the lower work roll 2 in the respective portions. As for the deflection state of the lower work roll 2, the positions of the pistons 33 of the respective fluid pressure cylinders 3 are detected and measured by the sensors 34, and the signals detected by the sensors 34 are fed to the arithmetic unit, for predetermined computation in the arithmetic unit, to adjust the oil pressure of the respective fluid pressure cylinders 30. The deflection state of the lower work roll 2 can be measured also be detecting the pressures of the fluid pressure cylinders, or by detecting both the positions of the pistons and the pressure of the fluid pressure cylinders. By adjusting the positions of the respective divided rolls 7 like this, the deflection of the lower work roll 2 can be freely adjusted at plural positions according to the rolling condition, etc.

The respective rolls can be exchanged according to the following procedures.

The divided rolls 7 are moved downstream in the rolling direction, and the backup roll is moved downward. The intermediate roll 5 can be exchanged, by drawing it in the width direction of the work 8 in this state. The lower work roll 2 can be exchanged by raising it, with the intermediate roll 5 drawn out. Furthermore, the pressure roll 6 can be exchanged in this state, by loosening the nuts 43 and disengaging the bolts 42 from the brackets 41. In this case, if the bolt hole of the bracket 41 is notched to allow the bolt 42 to be fitted in from a side of the bracket, the bolt 42 can be disengaged from the bracket 41, without removing the nut 43 perfectly.

The respective rolls can be fitted by working in reverse to the above. Since the pressure roll 6 can be moved in two directions as mentioned before, the centers of the lower work roll 2, the pressure roll 6 and the divided rolls 7 can be aligned on one line easily, even if the diameter of the lower work roll 2 changes.

As mentioned above, according to the second improvement of the present invention, a second example of the horizontal bending device to obtain a given bending curve in the work roll can be realized, and since the respective rolls can be singly removed, the roll exchange can be made very easily. Especially the pressure roll used in a severe condition can be easily exchanged, contributing to the enhancement of the operating ratio.

Figure 12:
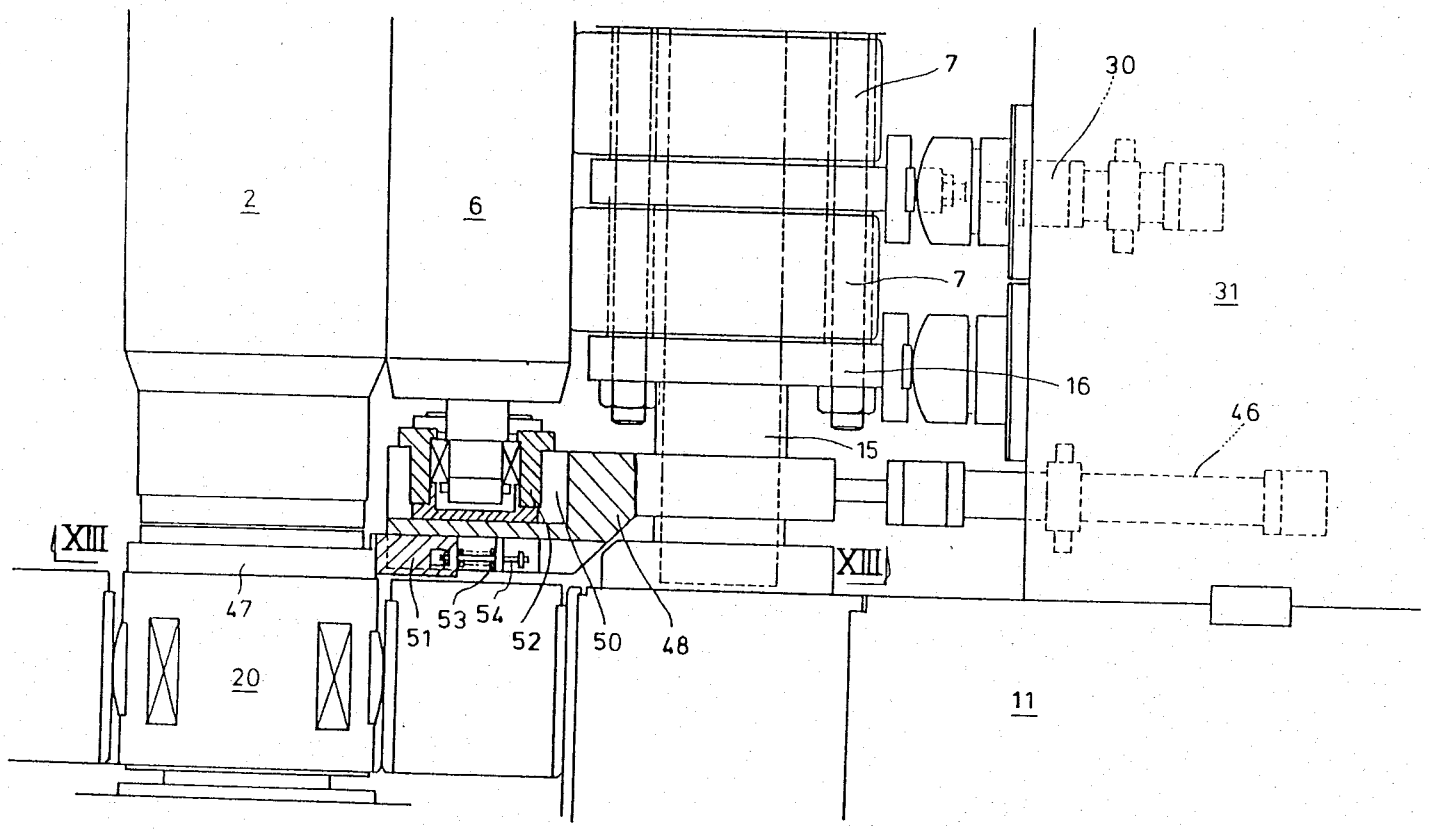
FIG. 12 is a view taken in the direction of the arrow XII—XII of FIG. 11.
Figure 13:
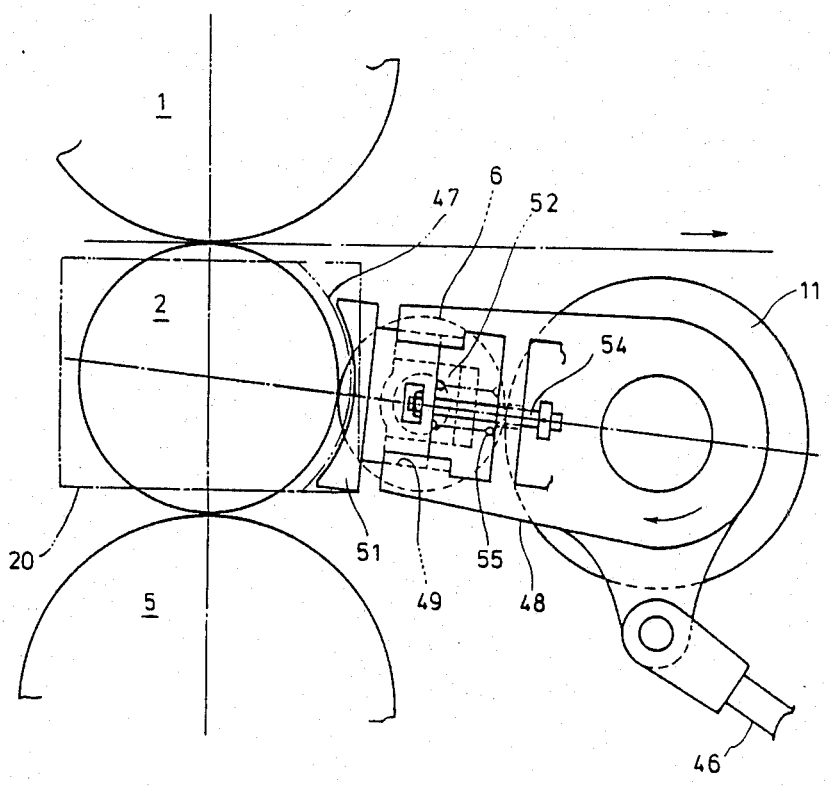
FIG. 13 is a view taken in the direction of the arrow XIII—XIII of FIG. 12.

Further with reference to FIGS. 11 to 13, the third improvement of the present invention will be described.

In the third improvement of the present invention, even if the diameters of the work rolls are changed, the shaft centers of the intermediate roll, the work rolls and the divided rolls can be held in one plane, for accurate adjustment of the deflection of the work roll by horizontal bending.

The parts which are the same as above are indicated by the same reference numerals, and the support mechanism of the divided rolls 7 and the bending device are structurally almost the same as those of the second improvement of the present invention.

A journal box 20 is provided at each end of the lower work roll 2, having a step 47 with a cylindrical guide face, the center of curvature of which is the same as the shaft center of the lower work roll 2. Each end of the shaft 15 is provided with a rotatable arm 48, and said arm 48 is provided with guide grooves 49 and 50 in the direction to approach and move from the shaft center of the lower work roll 2. A block 51 with a curved surface to be engaged with said step 47 is fitted in the guide groove 49, and the journal box 52 of the pressure roll 6 is fitted in the guide groove 50. Between the block 51 and the arm 48, a spring 53 biassing the block 51 toward the step 47 is held, and between the block 51 and the arm 48, a connector 54 preventing the leaving of the block 51 is provided. The guide groove 50 of the pressure roll 6 is so provided that when the block 51 is pressed toward the step 47, the shaft center of the pressure roll 6 may be positioned in the plane containing the respective shaft centers of the lower work roll 2 and the divided rolls 7. Furthermore, between the arms 48 and the beam 31, fluid pressure cylinders 46 are provided to rotate the arms 48 around the shaft center of the divided rolls 7.

Figure 11:
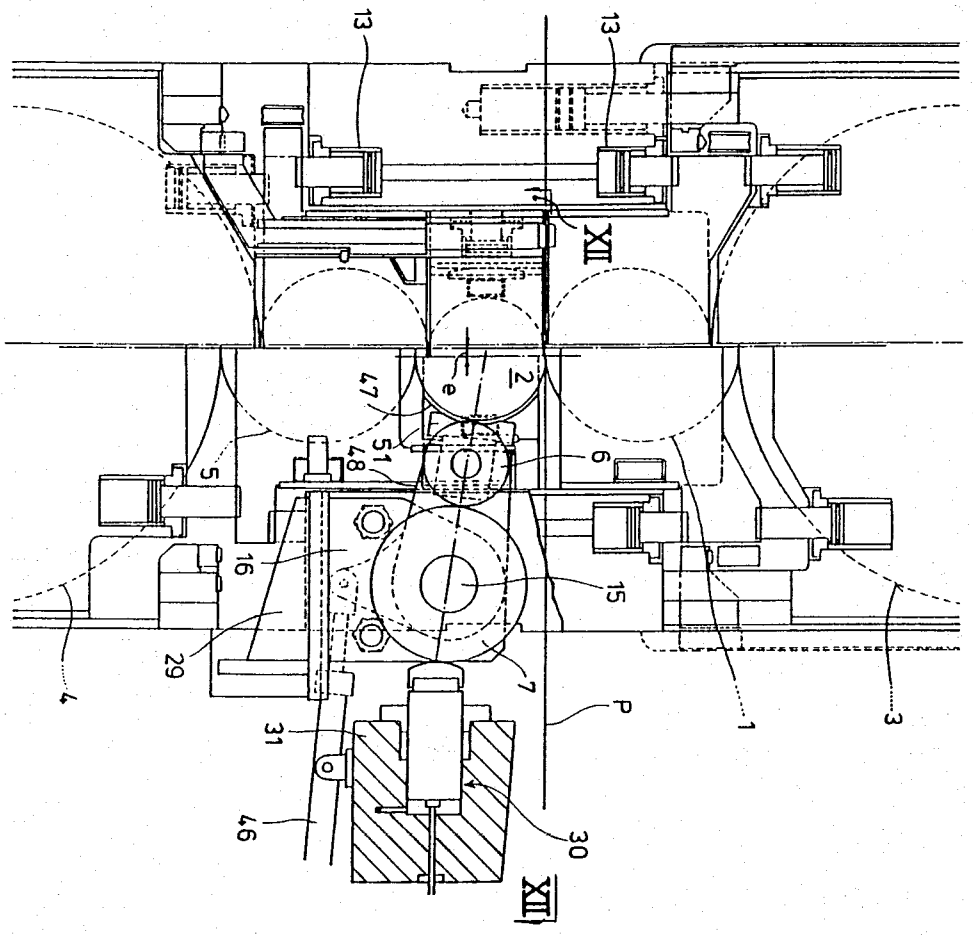
FIG. 11 is a cutaway side view of the rolling mill showing the third improvement of the present invention.

When the pressure roll 6 and the divided rolls 7 are going to be set in the state shown in FIG. 11 in preparation for rolling, the fluid pressure cylinders 46 are actuated to turn and hold the arms 48 in a predetermined direction, and other fluid pressure cylinders 30 are actuated to move the divided rolls 7 toward the lower work roll 2, causing the pressure roll 6 to contact the lower work roll 2. In this case, the blocks 51 are in pressure contact with the steps 47 by the force of the springs 53, and the shaft center of the pressure roll 6 is positioned in the plane containing the respective shaft centers of the lower work roll 2 and the divided rolls 7.

In this preparatory action, the divided rolls 7 can move horizontally, and the pressure roll 6 can rotate around the shaft center of the divided rolls 7, said pressure roll 6 being able to move in said plane. Therefore, irrespective of the diameter of the lower work roll 2, the pressure roll 6 and the divided rolls 7 can be arranged in an ideal state.

In the third improvement of the present invention, the pressure roll 6 is pivotally supported by the arms 48 as an example, but the pressure roll 6 can be pivotally supported by the blocks 51. Furthermore, since the step 47 provided at the journal box 20 is only required to guide the block 51 circumferentially around the roll shaft center, the guide surface is not required to form a continuous curved face.

According the the third improvement of the present invention, the pressure roll can be held always in a proper position, and even if the diameter of the work roll or intermediate roll changes, to change the shaft center position, the shaft center of the pressure roll is automatically displaced into a proper position. Therefore, the adjustment of the position of the pressure roll can be neglected. Furthermore, since the pressure roll can be held always in a proper position, the deflection of the work roll can be precisely adjusted, to increase the capability of controlling the flatness of the rolled product.

Figure 15:
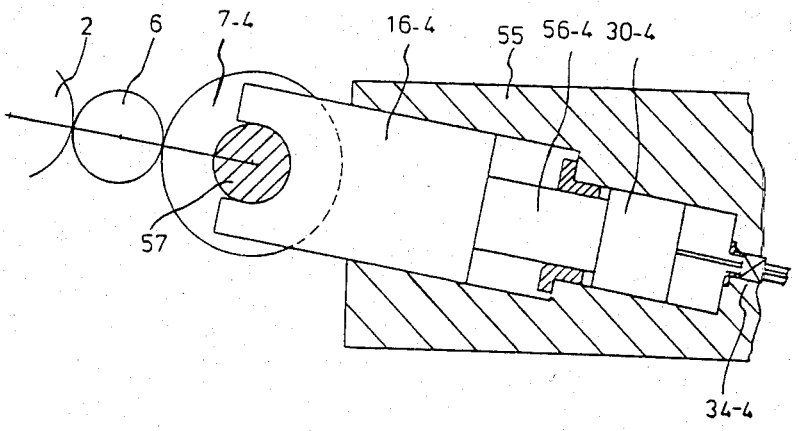
FIG. 15 is a view taken in the direction of the arrow XV—XV of FIG. 14.
Figure 16:
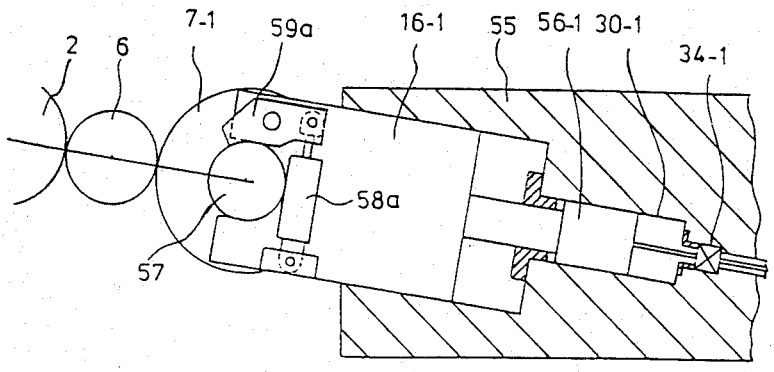
FIG. 16 is a view taken in the direction of the arrow XVI—XVI of FIG. 14.

Furthermore, with reference to FIGS. 14 to 16, the fourth improvement of the present invention will be described.

The fourth improvement of the present invention allows the horizontal bending force to be sensitively transmitted from the divided rolls to the work roll.

With a casing 55 fastened between the housings 11 of the rolling mill, fluid pressure cylinders 30-1, 30-2, . . . , 30-7 allowing piston rods 56-1, 56-2, . . . , 56-7 to advance and recede in the direction of the rolling line are provided in said casing 55 at required intervals in the width direction of the rolling mill. On the tip side of the casing 55, the movable plates 16-1, 16-2, . . . , 16-7 are provided to be slidable toward the lower work roll 2, by the piston rods 56-1, 56-2, . . . , 56-7.

The movable plates 16-1, 16-2, . . . , 16-7 are provided, at their tips, with horizontal U-shaped grooves in the surfaces on the side of the lower work roll 2, and a shaft 57 parallel to the lower work roll 2 is inserted in the grooves, being supported by the groove edges. Clamps 59*a* and 59*b* for holding the shaft 57, opened and closed by fluid pressure cylinders 58*a* and 58*b*, are pivotally fitted to the movable plates 16-1 and 16-7 on both sides, and divided rolls 7-1, 7-2, . . . , 7-6 are rotatably fitted on the shaft 57, to be positioned between the respective movable plates 16-1, 16-2, . . . , 16-7.

Between the lower work roll 2 and the divided rolls 7-1, 7-2, . . . , 7-6, the pressure roll 6, the center of which is positioned on a straight line connecting the center of the lower work roll 2 and the center of the divided rolls 7-1, 7-2, . . . , 7-6, is arranged in parallel to the lower work roll 2. At both the shaft ends of the pressure roll 6, journal boxes 52 are fitted to guide the pressure roll 6 to move in the same direction as the piston rods 56-1, 56-2, . . . , 56-7, though not allowing it move vertically. On the circumferential surface of the pressure roll 6, concave crowns are formed at the positions in contact with the divided rolls 7-1, 7-2, . . . , 7-6, to be large in diameter near the centers of the respective divided rolls in the width direction, and to be smaller according to the distance from the centers.

Then, at the time of rolling, pressure oil is supplied to the fluid pressure cylinders 30-1, 30-2, . . . , 30-7 to protrude the piston rods 56-1, 56-2, . . . , 56-7 individually by given distances, moving the movable plates 16-1, 16-2, . . . , 16-7 by given distances, thereby pressing the divided rolls 7-1, 7-2, . . . , 7-6 by the movable plates 16-1, 16-2, . . . , 16-7 at the respectively optional strengths to the pressure roll 6, to apply desired horizontal bending to the pressure roll 6.

Figure 14:
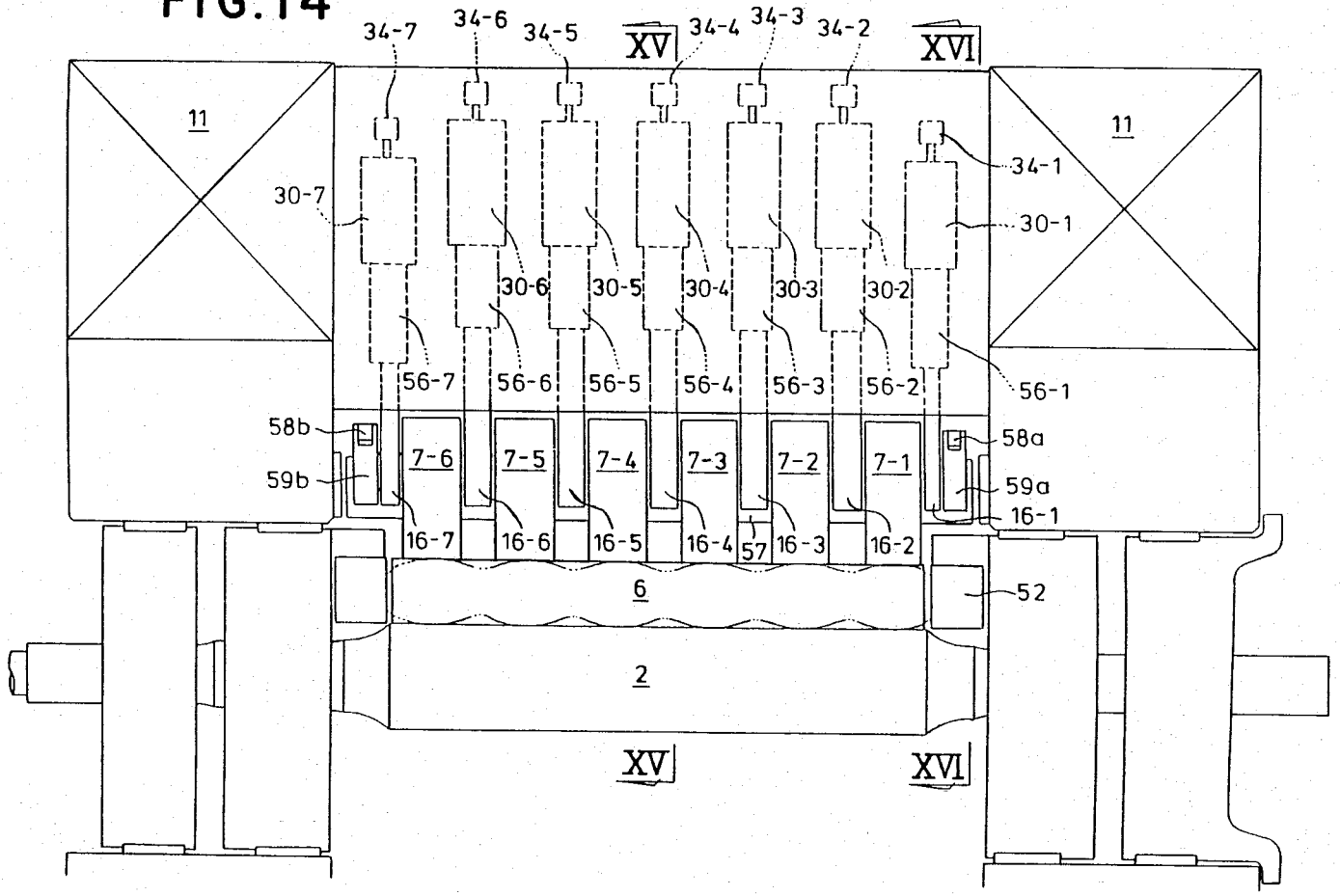
FIG. 14 is a partial plan view of the rolling mill showing the fourth improvement of the present invention.

In this case, since the pressure roll 6 is provided with concave crowns at the positions in contact with the divided rolls 7-1, 7-2, . . . , 7-6 as shown in FIG. 14, the bending forces from the respective divided rolls are sensitively transmitted to the lower work roll 2 at the positions corresponding to the respective divided rolls.

In the fourth improvement of the present invention, the shaft of the divided rolls is inserted in the horizontal U-shaped grooves provided in the support plate, with both the ends clamped. However, instead of the U-shaped grooves, round holes may be provided to have the shaft inserted through them. The roll which is offset and pressed by the pressure roll may be the upper work roll. Furthermore, as the actuators for pressing the pressure roll, wedges or screw rods may be used instead of the fluid pressure cylinders.

In the fourth improvement of the present invention, since the pressure roll is provided with concave crowns corresponding to the divided rolls, the displacement by horizontal bending can be effectively applied to the work roll. Therefore, the vertical displacement and deflection curve of the work roll can be set greatly and freely, and as a result, the flatness control function is further enhanced.

What is claimed is:

1. A multistage rolling mill with flatness control function comprising upper and lower work rolls, one of said work rolls being substantially smaller in diameter than the other work roll, upper and lower back-up rolls, said work rolls being driven, whereby rolling at different speeds is effected, said work roll of smaller diameter being offset in a rolling line with respect to axes of the upper and lower back-up rolls, an intermediate roll between said work roll of smaller diameter and the back-up roll of said work roll of small diameter, a vertical bending device provided for each of said work rolls and said intermediate roll, and a horizontal bending device for bending said work roll of smaller diameter horizontally; said other work roll and said intermediate roll being offset in the rolling line with respect to the axes of the upper and lower back-up rolls with said small diameter work roll, said intermediate roll and said back-up roll associated with said small diameter work roll all being arranged to have axes of rotation in a common plane.

2. A multistage rolling mill according to claim 1, wherein said other work roll and said intermediate roll are offset in the rolling line with respect to the axes of the upper and lower backup rolls.

3. A multistage rolling mill according to claim 1, wherein there is provided a pressure roll in contact with said work roll of smaller diameter, a shaft having divided rolls fitted thereon which are arranged along said pressure roll, movable plates arranged at both ends of the shaft and between the respective divided rolls for supporting the shaft, said movable plates being arranged to be slidable in the rolling direction, a fluid pressure cylinder connected with a corresponding movable plate for transmitting bending forces through the divided rolls to the said work roll of smaller diameter, and sensors for detecting moving distances of the divided rolls.

4. A multistage rolling mill according to claim 1, wherein there is provided a pressure roll in contact with said work roll of smaller diameter, a shaft having divided rolls fitted thereon which are arranged along said pressure roll, movable plates arranged at both ends of the shaft and between the respective divided rolls for supporting the shaft, said movable plates being arranged to be slidable in the rolling direction, a fluid pressure cylinder connected with a corresponding movable plate for transmitting bending forces through the divided rolls to the said work roll of smaller diameter, and sensors for detecting pressing forces of the divided rolls.

* * * * *